US005570955A

United States Patent [19]

Swartwout et al.

[11] Patent Number: 5,570,955

[45] Date of Patent: Nov. 5, 1996

[54] MODULAR HIGH SHEAR MIXER

[75] Inventors: James R. Swartwout, Redondo Beach; John J. Corrigan, Garden Grove, both of Calif.

[73] Assignee: Morehouse Cowles, Inc., Fullerton, Calif.

[21] Appl. No.: 242,612

[22] Filed: May 12, 1994

[51] Int. Cl.[6] ..... B01F 5/12

[52] U.S. Cl. ..... 366/264; 366/139; 366/286; 366/331

[58] Field of Search ..... 366/139, 279, 366/285, 286, 262, 263, 342, 343, 601, 264, 331

[56] References Cited

U.S. PATENT DOCUMENTS

| | | | |
|---|---|---|---|
| 1,768,927 | 7/1930 | Peters | 366/264 |
| 2,684,273 | 7/1954 | Fears | 366/343 |
| 2,718,385 | 9/1955 | Greblick | 366/264 |
| 2,967,433 | 1/1961 | Phillips | 366/285 |
| 2,985,389 | 5/1961 | Willems | 366/264 |
| 4,190,371 | 2/1980 | Durr | 366/139 |
| 4,437,765 | 3/1984 | Seeger | 366/264 |
| 4,575,255 | 3/1986 | Kafka | 366/343 |
| 4,893,942 | 1/1990 | Stottmann | 366/279 |
| 4,967,968 | 11/1990 | Vitelli | 366/279 |
| 5,267,790 | 12/1993 | Sutherland | 366/286 |

FOREIGN PATENT DOCUMENTS

| | | | |
|---|---|---|---|
| 93342 | 3/1962 | Denmark | 366/264 |
| 486215 | 11/1929 | Germany | 366/264 |

*Primary Examiner*—Robert W. Jenkins
*Attorney, Agent, or Firm*—Stetina Brunda & Buyan

[57] ABSTRACT

A modular high shear mixer has a shaft guard substantially enclosing the rotating mix shaft thereof and a mixing member guard substantially surrounding the mixing member formed upon the lower end of the mix shaft so as to enhance safety without undesirable affecting the performance of the mixer.. Modular construction facilitates both mechanical and fluid shearing utilizing a plurality of interchangeable mixing members. The mix shaft is driven by a AC motor, the speed of which is determined by a controller so as to eliminate the need for multiple pulleys.

8 Claims, 3 Drawing Sheets

51
26
47
50
46
16
45
49
27
56
52
54
62
60
40
58
41

62
41

40

68

42
66
64

74
44
68

Fig. 7
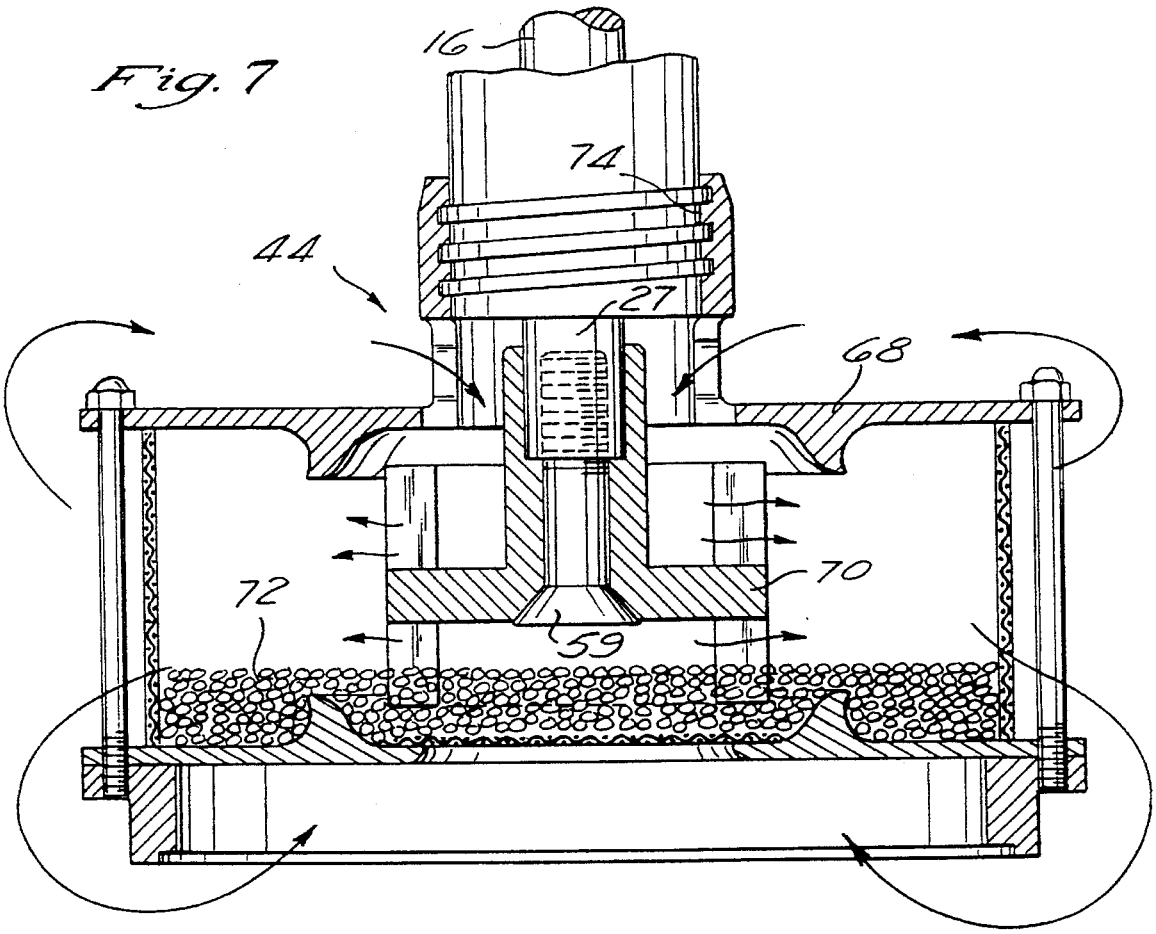
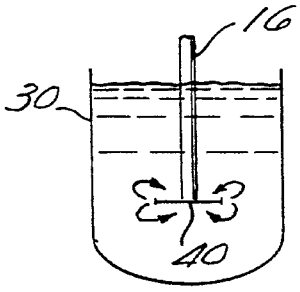
Fig. 8
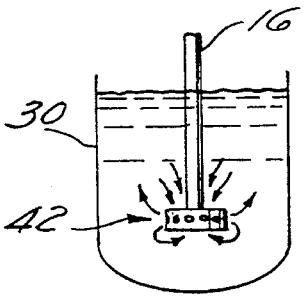
Fig. 9
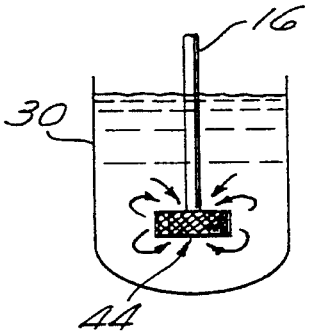
Fig. 10

MODULAR HIGH SHEAR MIXER

FIELD OF THE INVENTION

The present invention relates generally to mixers and more particularly to a modular high shear mixer having a plurality of interchangeable mixing members wherein a shaft guard substantially encloses the rotating mix shaft thereof and wherein a mixing member guard substantially surrounds the installed mixing member thereof so as to enhance safety without undesirable affecting the performance of the mixer.

BACKGROUND OF THE INVENTION

Mixers for mixing, dispersion, and milling of coatings, food, pharmaceuticals, etc. are well known. Such contemporary mixers generally comprise an AC motor mechanically coupled to a rotating shaft via a belt which is positionable upon a selected one of a plurality of pairs of pulleys so as to selectively vary the speed of a mixing member attached to the lower-most end of the mix shaft. The rotating mix shaft extends downwardly from a housing into a container within which the substance being mixed is contained.

Such contemporary devices are dedicated systems for either mixing, dispersing, or milling. Thus, the user must decide which processes are required for their particular application and then purchase the appropriate devices. If it is desired to perform both mixing and milling, for example, then a separate, dedicated mixer and miller are required to effect such processes. As those skilled in the art will appreciate, the use of such separate, dedicated devices not only increases the cost associated with the preparation of such coatings, food, pharmaceuticals, etc., but also makes such processes undesirably complex. Thus, because of the dedicated or single use nature of contemporary devices, a given mixture may have to be subjected to processing from a plurality of such devices.

As such, it would be beneficial to provide a modular system wherein a single apparatus provides for mixing, dispersing, and milling. Thus, not only is the initial expenditure associated with the purchase of such equipment substantially lowered, but the complexity of the process is consequently reduced. A number of different processes may be performed by a single apparatus, thereby eliminating the need to move the product from device to device, so as to effect the desired processes. Additionally, by reducing the number of devices required to perform such processes, the maintenance costs associated therewith are likewise reduced.

Another problem commonly associated with such contemporary mixers is the inadvertent and undesirable entanglement of various personal articles, i.e., ties, sleeves, lab coats, hair, etc., with the rotating mix shaft thereof, often having serious undesirable consequences.

As those skilled in the art are aware, such entanglement can result in property damage, personal injury, and even death.

Although it is known to provide a tubular shaft guard about the rotating shaft of contemporary mixers, such construction suffers from the inherent deficiency of making cleaning of the mixer difficult. The product being mixed soils both the interior of such a tubular shaft guard and the shaft itself as well. Thus, it is necessary that the shaft guard be removed from the shaft so as to facilitate cleaning of both the interior of the shaft guard and the shaft.

Although generally less accessible, the exposed mixing member of contemporary mixers presents a similar hazard in that the above-mentioned personal articles may become entangled therewith. Also, when the mixer is operating, it is possible for the mixing member to mangle a person's fingers, hands, and/or arms, if they should come into contact therewith. In those instances wherein the mixing member comprises sharp edges, it may also be hazardous for a person to come into contact therewith even when the mixer is not operating.

As such, it is also desirable to provide a means for shielding the rotating mix shaft and the mixing member from contact with a person and personal items, particularly during use thereof.

SUMMARY OF THE INVENTION

The present invention addresses and alleviates the above-mentioned deficiencies associated with the prior art. More particularly, the present invention comprises a modular high shear mixer comprising a plurality of interchangeable mixing members, a motor-driven mix shaft having upper and lower ends wherein a mixing member is disposed upon the lower end of the shaft, and a shaft guard substantially enclosing the shaft and extending generally from the upper end to the lower end thereof. A mixing member guard is attached to the lower end of the shaft guard and substantially surrounds the installed mixing member.

An oil cup is disposed about the upper end of the shaft guard and an aperture is formed in the shaft guard so as to provide fluid communication from the oil cup to the shaft. A first bearing is disposed at the upper end of the mix shaft and rotatably interconnects the mix shaft and the shaft guard at the upper ends thereof. A second bearing is disposed at the lower end of the mix shaft and rotatably interconnects the mix shaft and the shaft guard at the lower ends thereof.

The cup maintains a desired quantity of oil within the shaft guard so as to provide lubrication for the first and second bearings. Optionally, oil free bearings may be utilized.

A seal is formed at the lower end of the mix shaft so as to maintain oil within the shaft guard and thereby prevent oil leakage from the shaft guard. The seal also prevents soiling of the interior of the shaft guard and the shaft by the product being mixed, thereby making the cleaning process substantially easier. The sealed construction of the shaft guard according to the present invention prevents the product being mixed from contacting the interior of the shaft guard, as well as the enclosed portion of the shaft, and thus eliminates the need to remove the shaft guard from the shaft to clean the interior thereof as well as to clean the shaft itself.

The mixer preferably comprises an AC motor with a frequency inverter drive, a first pulley driven directly by the AC motor, a belt driven by the first pulley, and a second pulley attached to the mix shaft and driven by the belt. Thus, the mix shaft is driven by a single set of pulleys, rather than a plurality of interchangeable pulleys as in the prior art. Those skilled in the art will recognize that a DC motor may alternatively be utilized.

A controller varies the speed of the AC motor, thus eliminating the need for such a plurality of pulleys and consequently substantially simplifying the use of the high mixer of the present invention. Furthermore, the use of such an AC motor and controller facilitates precise control of the rotational speed of the mixing chamber.

A lift cylinder is preferably utilized for raising and lowering the mix shaft and mixing member so as to facilitate placement of a container thereunder.

A plurality of different interchangeable mixing members provide modular construction to enhance the utility of the present invention. For example, an impeller having a wire cage guard, a rotor/stator, and a canister mill may optionally be interchangeably mounted at the lower end of the mix shaft, as desired.

The impeller is typically utilized for traditional mixing and dispersion applications such as with paints, adhesives, resins, etc. The size and shape of the impeller's veins are optionally customized so as to enhance performance for specific applications.

The rotor/stator is typically used for formulating oil/resin and oil/water emulsions. The rotor/stator provides a mechanical shearing action so as to achieve maximum dispersion efficiency.

Optionally, a rotor/stator with both top and bottom inlet flow increases throughput and dispersion. Optionally, a bottom inlet only, low-foaming rotor/stator provides efficient emulsion of viscous mixtures with minimum aeration.

The canister mill provides enhanced dispersion of particles to sub-micron sizes. It has been found that significant mixing action occurs outside the canister, as a result of carefully optimized rotor and canister design and the selection of appropriate media, thus providing the possibility of single-vessel processing in many applications.

Vacuum milling can also be performed utilizing the canister mill mixing member of the present invention. The container is provided with the lid having a fitting for the attachment of a vacuum hose thereto, so as to facilitate such operation.

The container within which mixing is performed preferably comprises a wheeled vessel to facilitate positioning thereof beneath the mix shaft. The container is preferably pivotable via trunnions about a horizontal axis such that fluids are easily poured therefrom. As mentioned above, the container may be operated either at atmospheric pressure or a vacuum may optionally be formed therein.

Thus, a modular apparatus is provided wherein the user may mix, disperse, or mill a product, as desired, by merely interchanging the mixing members thereof. The use of such interchangeable mixing member thus facilitates the performance of a number of different process utilizing a comparatively inexpensive apparatus and simplifying the performance of such processes by eliminating the need to transfer the product among different devices. The high shear mixer of the present invention thus performs both mechanical shearing and fluid shearing, so as to further enhance its utility.

Safety is enhanced by providing both a shaft guard and guards for each mixing member. The shaft guard further simplifies clean-up since the seal at the lower end thereof keeps the mixed product out of the shaft guard.

These, as well as other advantages of the present invention will be more apparent from the following description and drawings. It is understood that changes in the specific structure shown and described may be made within the scope of the claims without departing from the spirit of the invention.

BRIEF DESCRIPTION OF THE DRAWINGS

FIG. 7 is an enlarged cross-sectional side view of the canister mill mixing member of FIG. 6;

FIG. 8 is a schematic representation of the impeller illustrating the function thereof;

FIG. 9 is a schematic representation of the rotor/stator illustrating the function thereof; and FIG. 10 is a schematic representation of the canister mill illustrating the function thereof.

DETAILED DESCRIPTION OF THE PREFERRED EMBODIMENT

The detailed description set forth below in connection with the appended drawings is intended as a description of the presently preferred embodiment of the invention, and is not intended to represent the only form in which the present invention may be constructed or utilized. The description sets forth the functions and sequence of steps for constructing and operating the invention in connection with the illustrated embodiment. It is to be understood, however, that the same or equivalent functions and sequences may be accomplished by different embodiments that are also intended to be encompassed within the spirit and scope of the invention.

Figure 1:
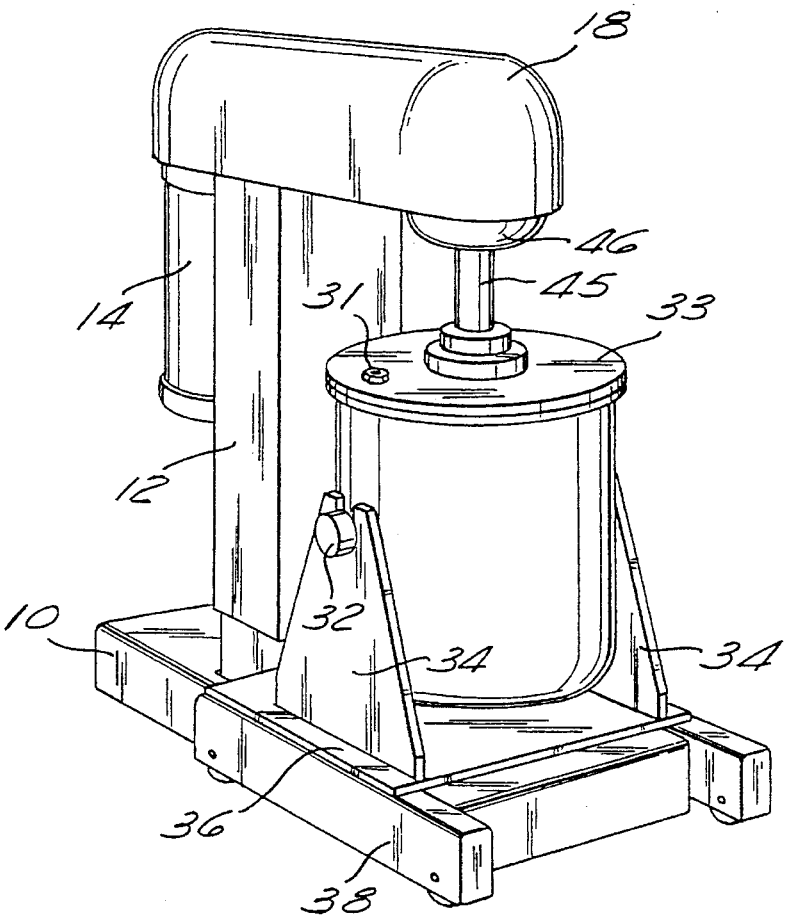
FIG. 1 is a perspective view of the high shear mixer of the present invention having the lower end of the mix shaft disposed within a container.
Figure 2:
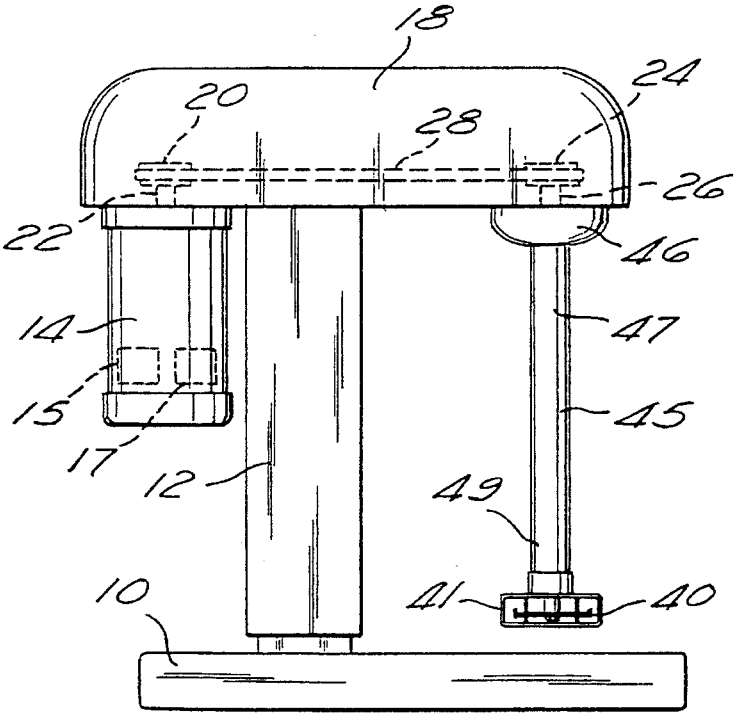
FIG. 2 is a side elevational view of the high shear mixer of FIG. 1 having the container removed therefrom.
Figure 3:
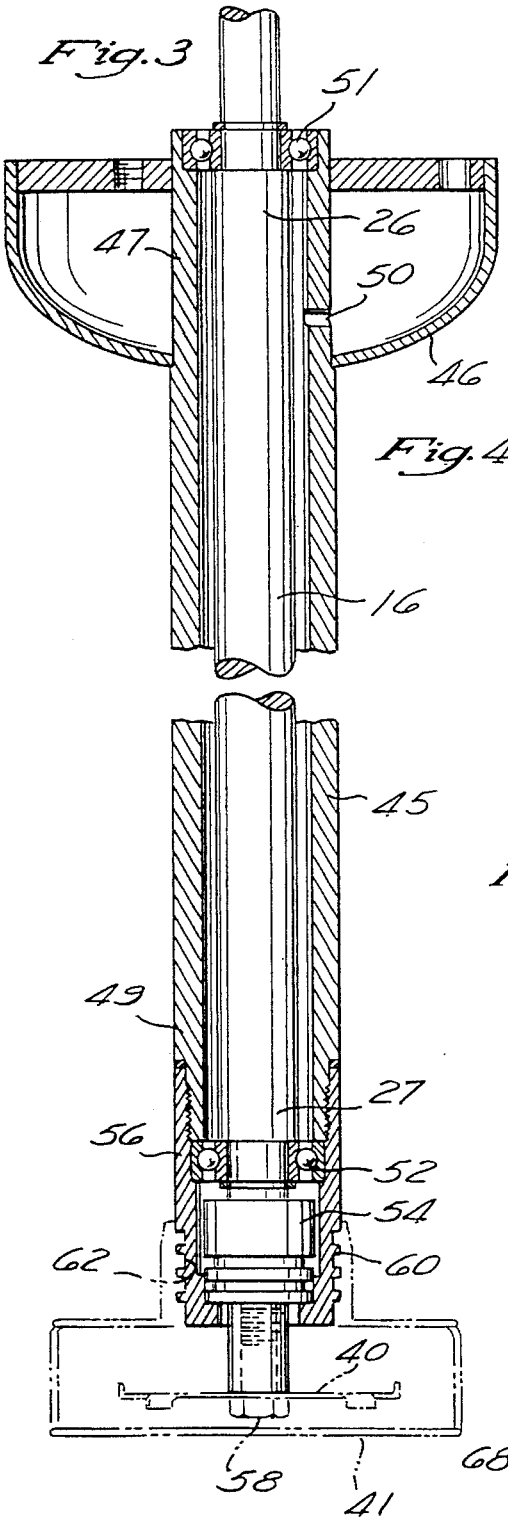
FIG. 3 is a cross-sectional side view of the shaft guard having the cup attached to the upper end thereof and an impeller and wire cage guard attached to the lower end thereof, the mix shaft being disposed therein.

The modular high shear mixer of the present invention is illustrated in FIGS. 1–10 of the drawings which depict a presently preferred embodiment of the invention. Referring now to FIGS. 1–3, the high shear mixer generally comprises a base 10 from which a vertical support member 12 upwardly extends, a motor 14 mounted to the vertical support member 12, and a rotating mix shaft 16 (FIG. 3) driven by the motor 14. A housing 18 covers a first pulley 20 formed upon the output shaft 22 of the motor 14. A second pulley 24 is formed upon the upper end 26 of the rotating mix shaft 16. A drive belt 28 extends between the first 20 and second 24 pulleys to facilitate driving of the mix shaft 16 via the motor 14.

The upwardly extending vertical member 12 preferably comprises a lift, preferably a pneumatic or hydraulic lift, to facilitate raising and lowering of the mix shaft 16 (along with the motor 14, housing 18, and associated drive components). Thus, the mix shaft 16 can be raised so as to facilitate the placement of a container 30 thereunder. The material to be mixed is placed within the container 30 and a mixing member 40 (FIG. 4), 42 (FIG. 5), or 44 (FIG. 6), attached to the lower end 27 of the mix shaft 16 is disposed within the container 30 so as to effect mixing of the contents thereof.

The container 30 preferably comprises trunnions 32 supported by trunnion supports 34 extending upwardly from base 36 formed upon roller cart 38. The trunnions 32 are attached to the container 30 so as to facilitate tipping of the container 30, such that the contents may be easily poured therefrom.

The container 30 preferably comprises a vacuum vessel such that the contents thereof may be mixed at a pressure lower than ambient. A port 31 facilitates the attachment of vacuum tubing to facilitate evacuation of the container 30. The port 31 may likewise be utilized for the introduction of a thermometer, thermocouple, or other instrumentation, as desired. Furthermore, the port 31 may be utilized for the introduction of various components of the substance being mixed.

A hollow cylindrical shaft guard 45 extends downwardly from the housing 18, substantially enclosing the mix shaft 16 therein. The shaft guard prevents contact at the rotating mix shaft 16 with personnel and/or their clothing, jewelry, etc.

With particular reference to FIG. 3, a cup 46 is formed at the upper end 47 of the shaft guard 45. An aperture 50 formed at the upper end 47 of the shaft guard 45 facilitates fluid communication from the cup 46 into the shaft guard 45. Oil disposed within the cup 46 flows through aperture 50 and onto lower bearing 52 and upper bearing 51, thus providing lubrication thereto. A seal 54 accommodates rotation of the mix shaft 16 therethrough and provides an oil seal between the mid shaft 16 and the lower end 49 of the shaft guard 45.

Figure 4:
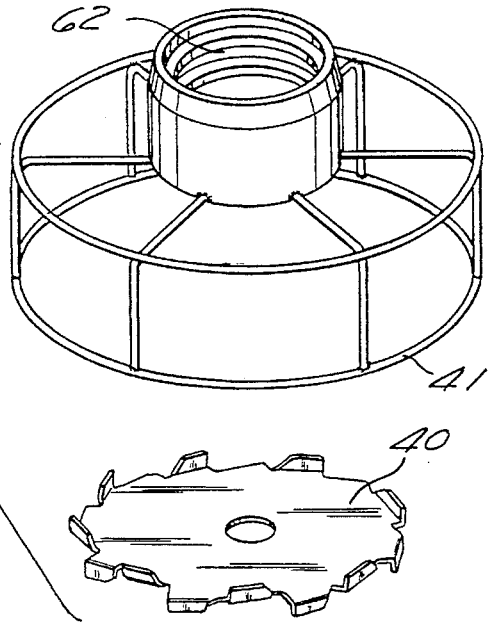
FIG. 4 is an exploded perspective view of an impeller mixing member and a wire cage guard.

A retaining member 56 preferably threads onto the lower end 49 of the shaft guard 45 and forms a portion thereof. The lower bearing 52 is preferably captured intermediate the retaining member 56 and the lower portion 49 of the shaft guard 45. The seal 54 is preferably disposed within the retaining member 56. The impeller 40 is preferably attached to the lower-most portion 27 of the mix shaft 16 via bolt 58. Referring now to FIGS. 3 and 4, the wire cage guard 41 is preferably attached to the retaining member 56 via course threads 60 formed upon the retaining member 56 and complimentary course threads 62 formed within the wire cage guard 41.

Figure 5:
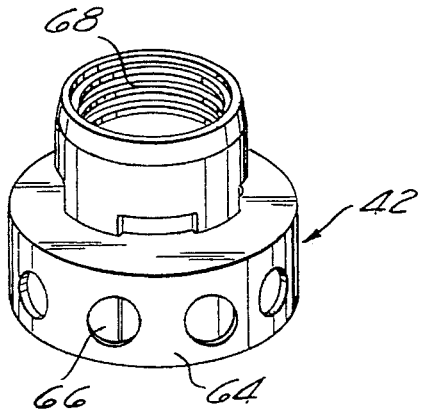
FIG. 5 is a perspective view of a rotor/stator mixing member.

Referring now to FIG. 5, the rotor/stator 42 comprises a stator 64 and a rotor 66 disposed therein. The stator 64 attaches to the retaining member 56 with course threads 68 in a manner similar to that of the wire cage guard 41. The rotor 66 attaches to the lower end 27 of the mix shaft 16 via a bolt 58 (FIG. 3) in a manner similar to that of the impeller 40.

Figure 6:
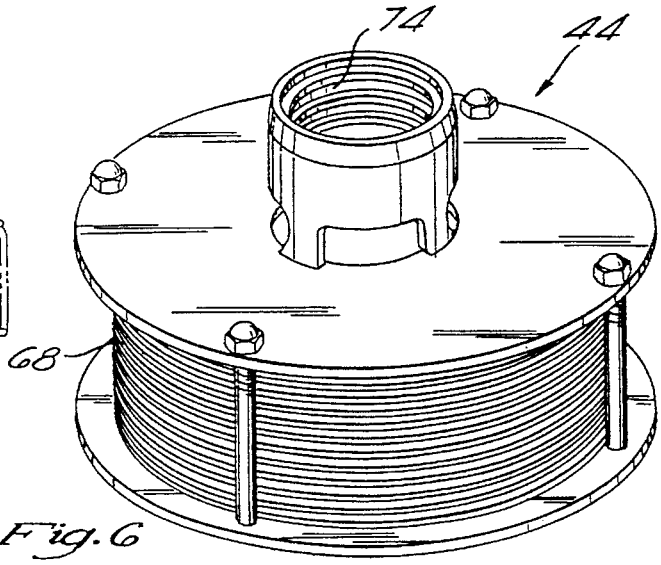
FIG. 6 is a perspective view of a canister mill mixing member.

Referring now to FIGS. 3, 6, and 7, the canister mill 44 comprises a stationary canister 68 having a rotating member 70 disposed therein such that the rotating member 70 agitates and causes to rotate substantially therewith media 72 likewise disposed within the canister 68. The rotating member 70 is attached to the lower end 27 of the mix shaft 16 via a bolt or other fastener such as screw 59. Like the wire frame guard 41 and the stator 64, the canister 68 attaches to the retaining member 56 via course threads 74 formed within the canister 68 which engage complimentary course threads 60 formed upon the retaining member 56.

Referring now to FIGS. 8, 9, and 10, the impeller 40 (FIG. 8) the rotor/stator 42 (FIG. 9), and the canister mill 44 (FIG. 10) may each be utilized, as desired, to effect desired mixing and/or milling processes. Those skilled in the art will recognize that a wide variety of different applications may be effected via the impeller 40, rotor/stator 42, and/or canister mill 44.

Having thus described the structure of the high shear mixer of the present invention, it may be beneficial to describe the operation and use thereof.

Referring now to FIGS. 1 and 2, the lift 12 is utilized to raise the mixing member, i.e., the impeller 40, to a height which allows the container 30 to be placed thereunder. The container 30 is then wheeled into position beneath the impeller 40, tilting the container 30 about trunnions 32, as necessary. The lift 12 is then lowered such that the impeller 40 rests proximate the bottom of the container 30. The components desired to be mixed are then placed in the container 30 and the top 33 placed thereon, if desired. A vacuum line, thermometer, thermocouple, etc. is then attached via port 31, as desired.

The controller 15 is utilized to cause the AC motor 14 to rotate at a speed which results in the desired rotational speed of the impeller 40. The frequency inverter drive 17 provides power to the AC motor 14, that drives the first pulley 20 via the AC motor output shaft 22. The first pulley 20 drives the belt 28, which in turn drives the second pulley 24. The second pulley 24 is attached directly to the rotating mix shaft 16, thereby effecting rotation thereof through the first 51 and second 52 bearings. The seal 54 prevents leakage of the oil contained within the shaft guard 45 into the container 30, thereby contaminating the substances being mixed.

The mixing member may be changed by unthreading the wire cage 41 from the retaining member 56 and unbolting the impeller 40 from the lower end 27 of the rotating mix shaft 16. A different mixing member, i.e., the rotor/stator 66 or the canister mill 44 may then be attached by threading the stator 64 or canister 68 onto the retaining member 56 and bolting the rotor 66 or rotating member 70 to the lower end 27 of the rotating mix shaft 16.

Vacuum milling may be performed by utilizing the canister mill 44 and applying a vacuum source to the fitting 31 on the lid 33 of the container 30. Those skilled in the art will recognize the various other mixing, dispersion, and milling operation may similarly be performed with or without vacuum according to the methodology of the present invention.

The sealed shaft guard 45 of the present invention eliminates the need for removal of the shaft guard 45 after use so as to facilitate cleaning of the interior thereof and cleaning of the shaft 16. The seal 54 prevents soiling of the shaft 16 and the interior of the shaft guard 45 with the mixed product.

It is understood that the exemplary high shear mixer described herein and shown in the drawings represents only a preferred embodiment of the invention. Indeed, various modifications and additions may be made to such embodiment without departing from the spirit and scope of the invention. For example, those skilled in the art will recognize that various mixing members, other than those illustrated and discussed, may be utilized. Also, various configurations of the container are contemplated. Also, various other means for attaching the impellers, rotor, and canister are contemplated. For example, these components may bolt on, screw on, snap on, etc. Thus, these and other modifications and additions may be obvious to those skilled in the art and may be implemented to adapt the present invention for use in a variety of different applications.

What is claimed is:

1. A mixer comprising:

a) a motor-driven shaft having upper and lower ends;

b) a first mixing member disposed upon the lower end of said shaft; and c) a shaft guard substantially enclosing said shaft and extending generally from the upper end to the lower end thereof;

further comprising;

d) an oil cup disposed about the upper end of said shaft guard;

e) an aperture formed in said shaft guard so as to provide fluid communication from said oil cup to said shaft;

f) a first bearing disposed at the upper end of said shaft and rotatably interconnecting said shaft and said shaft guard;

g) a second bearing disposed at the lower end of said shaft and rotatably interconnecting said shaft and said shaft guard; and h) a seal formed at the lower end of said shaft to maintain oil within said shaft guard and upon said first and second bearings and to prevent oil leakage from said shaft guard.

2. The mixer as recited in claim 1 further comprising:

a) a AC motor;

b) a first pulley driven by said AC motor;

c) a belt driven by said first pulley;

d) a second pulley attached to said shaft driven by said belt;

e) a controller for varying the speed of said AC motor; and f) wherein the use of multiple pulleys for varying the speed of said shaft is eliminated by the use of said controller and said AC motor.

3. The mixer as recited in claim 2 further comprising a frequency inverter drive for driving said AC motor.

4. The mixer as recited in claim 1 further comprising a lift cylinder for raising and lowering the shaft to facilitate placement of a container thereunder.

5. The mixer as recited in claim 1 further comprising a container into which said first mixing member is disposable so as to mix the contents thereof.

6. The mixer as recited in claim 5 wherein said container comprises a sealed vacuum container.

7. A mixer comprising:

a) a motor-driven shaft having upper and lower ends;

b) a first mixing member disposed upon the lower end of said shaft; and c) a shaft guard substantially enclosing said shaft and extending generally from the upper end to the lower end thereof;

further comprising at least one second mixing member interchangeable with said first mixing member said first and second mixing members selected from the group consisting of:

i) an impeller having a wire cage guard;

ii) a rotor/stator; and iii) a canister mill;

wherein:

i) said impeller is attachable to said shaft via a screw and said wire cage guard is attachable to said shaft guard via course threads;

ii) said rotor is attachable to said shaft via a screw and said stator is attachable to said shaft guard via course threads;

iii) said canister mill driver is attachable to said shaft via a screw and said canister mill canister is attachable to said shaft guard via course threads.

8. A mixer comprising:

a) a rotating mix shaft having upper and lower ends;

b) a plurality of interchangeable mixing members attachable to the lower end of said mix shaft;

c) a shaft guard substantially enclosing said mix shaft and extending generally from the upper end to the lower end thereof;

d) a first bearing disposed at the upper end of said shaft and rotatably interconnecting said shaft and said shaft guard; and e) a second bearing disposed at the lower end of said shaft and rotatably interconnecting said shaft and said shaft guard.

* * * * *